US009829253B2

(12) United States Patent
Mishkinis et al.

(10) Patent No.: US 9,829,253 B2
(45) Date of Patent: Nov. 28, 2017

(54) ADVANCED CONTROL TWO PHASE HEAT TRANSFER LOOP

(71) Applicant: Ibérica del Espacio, S.A., Madrid (ES)

(72) Inventors: Donatas Mishkinis, Madrid (ES); Alejandro Torres Sepúlveda, Madrid (ES)

(73) Assignee: Ibérica del Espacio, S.A., Madrid (ES)

( * ) Notice: Subject to any disclaimer, the term of this patent is extended or adjusted under 35 U.S.C. 154(b) by 171 days.

(21) Appl. No.: 14/823,205

(22) Filed: Aug. 11, 2015

(65) Prior Publication Data

US 2016/0047605 A1 Feb. 18, 2016

(30) Foreign Application Priority Data

Aug. 14, 2014 (EP) ..... 14180917

(51) Int. Cl.
*F28F 27/00* (2006.01)
*F28D 15/04* (2006.01)
(Continued)

(52) U.S. Cl.
CPC ..... *F28D 15/043* (2013.01); *F28D 15/0266* (2013.01); *F28D 15/06* (2013.01)

(58) Field of Classification Search
CPC ..... F28D 15/043; F28D 15/0266; F28D 15/06
(Continued)

(56) References Cited

U.S. PATENT DOCUMENTS 4,515,209 A 5/1985 Maidanik et al.
5,944,092 A 8/1999 Van Oost
(Continued)

FOREIGN PATENT DOCUMENTS

RU 2120592 C1 10/1998
SU 1395927 A2 5/1988
(Continued)

*Primary Examiner* — Davis Hwu
(74) *Attorney, Agent, or Firm* — Bachman & LaPointe, PC

(57) ABSTRACT

The advanced control heat transfer loop apparatus (1) for heat transfer and thermal control applications uses a two-phase fluid as a working media and comprises at least one evaporator (2) to be connected with a heat source and comprising primary capillary pump (4), a thermal stabilization-compensation chamber (3) being attached to the at least one evaporator (2), at least one condenser (24) to be connected with a heat sink, liquid lines (22) and vapor lines (23) connecting the at least one evaporator (2) and the at least one condenser (24), a remote compensation chamber (20), temperature sensors (27) for detecting the temperature of the remote compensation chamber (20) and at the thermal stabilization compensation chamber (3) attached to the at least one evaporator (2), at least one heating element (19) for heating the remote compensation chamber (20), and a controller (28). The controller (28) is configured to monitor the temperatures detected by the sensors (27) and to control the heating element (19) in such a way that the value of the difference $\Delta T_{Control}$ between the temperature of the remote compensation chamber (20) and the temperature of the thermal stabilization-compensation chamber (3) attached to the at least one evaporator (2) is positive.

11 Claims, 5 Drawing Sheets

(51) Int. Cl.
*F28D 15/02* (2006.01)
*F28D 15/06* (2006.01)

(58) Field of Classification Search
USPC ..... 165/272
See application file for complete search history.

(56) References Cited

U.S. PATENT DOCUMENTS

| | | | | |
|---|---|---|---|---|
| 6,626,231 | B2 | 9/2003 | Cluzet et al. | |
| 6,810,946 | B2 | 11/2004 | Hoang | |
| 6,889,754 | B2 | 5/2005 | Kroliczek et al. | |
| 6,948,556 | B1 | 9/2005 | Anderson et al. | |
| 6,990,816 | B1 | 1/2006 | Zuo et al. | |
| 7,004,240 | B1 | 2/2006 | Kroliczek et al. | |
| 7,061,446 | B1 | 6/2006 | Short, Jr. et al. | |
| 7,118,076 | B2 | 10/2006 | Tjiptahardja et al. | |
| 7,251,889 | B2 | 8/2007 | Kroliczek et al. | |
| 7,268,744 | B1 | 9/2007 | Short, Jr. et al. | |
| 7,549,461 | B2 | 6/2009 | Krolizek et al. | |
| 7,661,464 | B2 | 2/2010 | Khrustalev et al. | |
| 7,841,392 | B1 | 11/2010 | Short, Jr. et al. | |
| 8,047,268 | B1 | 11/2011 | Kroliczek et al. | |
| 8,066,055 | B2 | 11/2011 | Kroliczek et al. | |
| 8,109,325 | B2 | 2/2012 | Kroliczek et al. | |
| 9,146,059 | B2 * | 9/2015 | Hoang | F28D 15/043 |
| 2004/0182550 | A1 | 9/2004 | Kroliczek et al. | |

FOREIGN PATENT DOCUMENTS

| | | | |
|---|---|---|---|
| WO | 0202201 | A2 | 1/2002 |
| WO | 2014102402 | A1 | 7/2014 |

* cited by examiner

ADVANCED CONTROL TWO PHASE HEAT TRANSFER LOOP

FIELD OF THE INVENTION

The present invention relates to a heat transfer and thermal control apparatus and method, in particular for use for electronic equipment cooling, and more particularly the invention is directed to a heat transfer and advanced thermal control apparatus with two-phase heat transfer loop application for spacecraft electronics thermal management.

BACKGROUND OF THE INVENTION

Components and subsystems of electronic equipment such as microprocessors, microcontrollers, transformers, filters, semiconductors, transistors, amplifiers, multiplexers, integrated circuits, etc., must operate in restricted temperature ranges. Specifically it is related to spacecraft electronics. This makes thermal control a key matter in the design and operation of a spacecraft with a significant weight, power and cost impact in the overall spacecraft budget.

Spacecraft thermal control relies on the global spacecraft thermal balance: the heat loads must be rejected to deep space that works as a thermal sink. Since no matter links this sink and the spacecraft, this rejection is made by thermal radiation through dedicated radiators installed on the satellite external surfaces.

Spacecraft thermal loads come from the internal spacecraft equipment dissipation and, externally, from the sun and the earth or from the celestial bodies around which the spacecraft orbits. The thermal systems used in spacecrafts must therefore be able to control equipment which operates at a specified range of temperatures and also discontinuously.

At present, known thermal devices for controlling thermal loads in spacecraft are two phase heat transfer loops (HTL) which are also known in engineering practice as capillary driven and mechanically pumped loops or heat loops. The purpose of these devices in a spacecraft is to transfer heat between a heat source (electronic element) and a heat sink (typically, the space). In two phase HTLs heat is transferred through an evaporation-condensation cycle of a working fluid kept inside a hermetically sealed container.

A two phase HTL is filled by working fluid, which is called heat carrier. During nominal operation of the two phase HTL, two phases of this heat carrier, vapor and liquid, are always present in the circuit.

Known two phase HTLs usually comprise at least six elements: an evaporator, a pump, a vapor transport line, a condenser, a liquid transport line and a compensation chamber. Heat applied to the evaporator from electronic equipment is used for phase transformation of working fluid from liquid to vapor. Vapor is moving to the condenser in the vapor transport line. The heat accumulated in the vapor phase is dissipated in the condenser by condensation. Released liquid is transmitted back to the evaporator through the liquid transport line by the pump. The compensation chamber can be installed in different locations of the loop and provides the capability of the loop to operate at different environmental and operational scenarios: to guarantee a sufficient amount of fluid for circulation at cold conditions and to accumulate the excess of liquid due to thermal expansion effect in hot conditions.

Different mechanisms can be used for fluid pumping in the HTL. Capillary driven loops use the capillary suction effect for this purpose and they have a special porous structure, called capillary pump or wick, served for working fluid continuous circulation in the system. The wick is always located in the evaporator. The evaporator is attached to a heat source.

The above-mentioned capillary driven loop technology has found a wide application for thermal control systems in many spacecraft applications, which usually use loops with a single evaporator. However, many applications require thermal control of large thermal contact surface payloads or multiple remotely located heat sources.

Developers of multiple evaporators and multiple condenser designs of capillary driven loops (known in engineering practice as loop heat pipes (LHP), capillary pumped loops (CPL), hybrid two-phase heat loops) intend to create thermal control systems having the following characteristics: optimized functional layout, scalability, expandability, effective heat loads sharing, flexibility in components locations, thermal coupling between separate radiators and minimized mass and volume.

The LHP technology was initially invented in the Soviet Union, and this technology of a heat transfer apparatus is known as per U.S. Pat. No. 4,515,209, for example. Later, a capillary link (secondary wick) between the evaporator and the compensation chamber was introduced to provide liquid supply from the compensation chamber to the evaporator primary wick in zero gravity conditions.

The development and testing of an LHP with two identical evaporators was first performed by the Institute of Thermal Physics (Russian Academy of Sciences) in the mid-80's. Further developments into a multi-evaporator LHP system, as shown for example in USSR Patent 1395927, were carried out using an LHP with two evaporators and two condensers. The two-evaporator LHPs can efficiently operate at symmetrical and non-symmetrical heat load distributions between the evaporators, and at different temperatures of the condenser(s) cooling. However, shutting down the active cooling of one condenser would result in an abrupt decrease in the maximum transport capability of the device.

Every evaporator in the typical LHP system has its own compensation chamber, which can be directly connected to the compensation chambers of other evaporators or can have no direct connection with the compensation chambers of other evaporators in the system. In these devices, evaporators are rigidly connected with each other and are at a relatively close distance from each other.

Despite evident advantages of LHP systems having multiple evaporators designed to operate over a wide temperature range, there exists a limitation on the number of evaporators that can be reasonably used, as each evaporator comprises a compensation chamber. As the minimum operating temperature decreases, the compensation chamber volume increases rapidly when the number of evaporators increases. This leads to a limitation on the number of evaporators that can be used in these systems. It is practically impossible to build an LHP system with more than three evaporators.

Besides, certain problems can also exist with the temperature control in multi-evaporator LHP systems: the key components for the LHP temperature control are the compensation chambers. In a two-evaporator installation, the LHP can operate at the desired temperature in most of the cases, as the LHP responds very well to rapid changes of heat load, sink temperature and set point temperature. However, only one of the compensation chambers has a vapor-liquid two-phase condition during operation regardless of how many are under temperature control.

The heat, which passed by thermal conduction through the capillary pump wall into the central part of the evaporator, in the way opposite to the fluid circulation direction, is called parasitic heat leak. Test results showed that when one of the evaporators has a very low heat load, a sudden vapor generation on the inner surface of the capillary pump was observed, stridently increasing the parasitic heat leak to the compensation chamber which results in a higher operational temperature of the loop. This causes a hysteresis control problem for the loop that is hard to predict or prevent. Also, it was found that situations when the liquid distributes itself among the compensation chambers (trying to occupy the lowest pressure spots) can lead to unstable operation of the system. Furthermore, a problem of controllability for multi-evaporator LHP systems arises when the amount of evaporators and compensation chambers increases.

Therefore, it is possible to conclude that an expandability limitation is the main problem in multi-evaporator LHP systems, as shown in USSR Patent 1395927, such that two evaporators are used or only three evaporators maximum for narrow temperature ranges. A secondary problem presented by these systems too is poor controllability.

Another type of a capillary driven loop is CPL, as for example in documents U.S. Pat. No. 6,626,231 and U.S. Pat. No. 7,118,076, typically comprising one or more evaporators, one or more condensers, transport lines, one remote compensation chamber and a sub cooler. The location of the compensation chamber is the main distinguishing feature between CPL and LHP designs. An LHP compensation chamber (or chambers for LHP multi-evaporator design) is always directly attached to the evaporator but CPL always has one remote compensation chamber (also known as liquid reservoir), separated from the evaporator (or evaporators for CPL multi-evaporator design) by small diameter (2-5 mm) connecting pipe(s). As a rule, in CPL, liquid from the condenser and from the remote compensation chamber flows through the sub cooler before reaching the evaporators. Conversely to LHP the CPL has a reduced ability for self-start up without special preconditioning. Besides, for any CPL, the tolerance for vapor parasitic heat leak is a significant problem of reliable operability of the system. The growing of a vapor bubble on the inner surface of the capillary pump leads to the pump dryout and, finally, to the failure of CPL operation. In case of LHP, the bubble usually migrates into the compensation chamber (as soon as it is closely attached to the evaporator) and condenses in sub cooled liquid which is always presented in the LHP compensation chamber.

Continued improvements have been made to the CPLs in the last decades. The two-port evaporator (one liquid inlet and one vapor exit) initially used in CPLs generally experienced dry-out due to the appearance of vapor in the liquid core during start-up and transient regimes. To prevent vapor from blocking liquid return to the wick structure, a three-port capillary evaporator was introduced in the system connecting the remote reservoir line to the liquid core of the evaporator. This configuration allows vapor to expand along the evaporator core and to migrate into the remote reservoir, instead of accumulating in the evaporator core and interfering with liquid returning from the condenser. Initially, three-port capillary pumps were used as starter pumps, and then like the main functional evaporator design. To prevent vapor from deprimed evaporators to flow upstream and to block liquid return to operating evaporators, a capillary device, known as a capillary isolator, was introduced, located upstream of the evaporator inlet. Back pressure regulators were also installed in many multiple evaporator CPLs to assist start up. These capillary devices, located in the vapor transport line, redirect vapor initially generated at one evaporator to other inoperative (without heat load) evaporators. This action forces liquid from the vapor lines and improves the chances for a successful start up for all evaporators in the system: it is also helping to promote heat load sharing among evaporators, for instance, when an inoperative evaporator acts as a condenser.

The following conclusions summarize the issues related to CPL reliability:

- CPL design should never allow bubbles to form in the liquid side of the loop, but it is quite difficult to fully avoid such operational scenario in actual HTLs;
- CPL requires a start up evaporator to clear the vapor channels in the main evaporators before heat is applied to them;
- reducing the diameter of the CPL evaporator elements leads to many unexpected difficulties: the design with thinner capillary pump walls leads to higher probability of vapor bubble formation inside of the liquid core of the evaporator and as consequence to failure of CPL operation;

It is known in the state of the art, that in order to improve vapor parasitic heat leak tolerance of evaporators, it is preferable to connect these evaporators in series; in this case the first evaporator in series can develop a sweeping flow for the following evaporators.

Another solution is to have several parallel evaporators connected to the same compensation chamber, located at the evaporating part of the loop, and including special long capillary links between the evaporators and the compensation chamber. This system is known as Free Location LHP CPL, as shown for example in documents U.S. Pat. No. 5,944,092 or Russian Patent 2120592. This system was successfully tested on the ground with a favourable gravitational bias of the evaporators relative to the compensation chamber, making it easy for the capillary links to distribute the fluid to each evaporator. Orientation constraint in gravity field is due to limits imposed by the capillary link. The capillary link connecting the evaporators to the compensation chamber limits the separation distance between the evaporators and the compensation chamber. This limitation is similar to the heat pipes existing in conventional art. Other significant limitations of this design are complexity and integration difficulties which lead to problems of system expandability, scalability and part standardization. All evaporators have to be below or in the same plane with respect to the plane of the compensation chamber. Since the tube connecting each evaporator to the compensation chamber contains a capillary link inside, the tube internal diameter is typically greater than 4 mm, (it is practically impossible to allocate a bendable capillary structure in smaller diameter tubing). Large diameter connecting tubing leads to inflexible system and high requirements for tolerances for integration purposes. In the usual design of a LHP evaporator with a bayonet tube, a capillary link (secondary wick) supplies the primary capillary pump with liquid practically only in transient regimes. However, in this design, the capillary link supplies all amount of liquid that is needed for the evaporator, which leads to significant limitations for rates of change of heat source power or/and heat sink temperature. Other disadvantage of such an approach is the low thermal conductance of evaporators due to the permanent presence of vapor phase in the evaporator core.

An attempt to overcome some of these significant drawbacks led to a so called multi-free LHP CPL known for example per U.S. Pat. No. 5,944,092, where functional evaporators do not have a capillary link to the compensation chamber, only to the liquid line. Limitations of this design are similar to those of ordinary CPLs with starter pumps. Capillary evaporators linked to the liquid line cannot provide a reliable vapor tolerance and, therefore, this design presents the drawback of the necessity of an additional special evaporator with dedicated power source to provide the loop circulation.

Further designs were made developing the so called multi-evaporator hybrid LHP, as known for example in documents U.S. Pat. No. 7,661,464, U.S. Pat. No. 6,889,754, U.S. Pat. No. 7,004,240, U.S. Pat. No. 8,047,268, U.S. Pat. No. 7,549,461, U.S. Pat. No. 8,109,325, U.S. Pat. No. 8,066,055 or U.S. Pat. No. 7,251,889, suggesting that a link between evaporators and compensation chamber could itself be a loop and incorporated this idea in a so called advanced CPL, as an attempt to incorporate both the advantages of a robust LHP and the architectural flexibility of a CPL. This system comprises two relatively independently operated loops, a main loop and an auxiliary loop. The main loop is basically a traditional CPL with the same configuration and operational principles as for CPL, whose function is to transport the waste heat and reject it to a heat sink via the primary condenser. The auxiliary loop is used to remove vapor bubbles from the core of the CPL evaporators and move them to the compensation chamber. The auxiliary loop contains only one LHP-type evaporator with the attached large compensation chamber. The chamber is only one and it is common for all evaporators: the CPL evaporators in the main loop and the LHP evaporator in the auxiliary loop. In addition, the auxiliary loop is also used to ease the start-up process. In this manner, the auxiliary loop functionally replaces the secondary wick of a conventional LHP. The feasibility of this design was however only achieved when the evaporators were connected in series. This means that liquid consequently goes through the evaporators: flow leaving the first evaporator enters the second one, etc.

Initially, the multi-evaporator hybrid LHP included three evaporators, one of which was a standard LHP evaporator directly attached to the common system's compensation chamber, and two traditional three-port CPL evaporators. Tests indicated that the system was not very reliable during power cycling. The sensitivity to power cycle was attributed to the expansion of vapor bubbles in the evaporator core. Heat conduction through the wall of the evaporator capillary pump made it relatively easy to nucleate vapor in the evaporator core. In case of steady state operation, these bubbles were swept from the core of functional evaporators by forward flow of the liquid to the capillary pump. However, as the functional evaporators input power decreased, liquid movement forced by capillary action on the auxiliary evaporator was not enough to efficiently remove all vapor bubbles from the evaporator core to prevent vapor blockage of the capillary pump (dryout) after sudden increase of the evaporator power. On the other hand, sudden power reduction leads to temporary fluid flow break in the condenser until new stable temperature/pressure equilibrium was established in the system. This flow break therefore required a net flow mass displacement from the evaporator and the compensation chamber to the condenser. As a result, nominal forward direction flow was disrupted. During this reversal flow, vapor bubbles could then accumulate or even expand in the evaporator capillary pump core, therefore causing evaporator dry-out and failure of the system.

To improve vapor tolerance, the internal design of the evaporators was modified to include a special phase separation wick, designed to provide better control of the two phases vapor/liquid distribution in the core of the pumps. The design modifications were intended to extend the phase control provided by the secondary wick in the traditional LHP evaporator to the CPL evaporators. Despite general successful results obtained during testing, the operation was verified in relatively limited conditions: mostly in horizontal orientation, evaporators were located close to each other, and therefore with similar hydraulic resistance of lines. Therefore, such configuration was not representative of the conditions of potential spacecraft thermal control application when evaporators and remote reservoir are spatially separated, and the rate of evaporator's response on variations of the input power and heat sink conditions depend on the length of the lines connecting these elements. Therefore, the ability for temperature control was not properly verified.

Also known in the art are hybrid cooling loop technologies, as those shown for example in documents U.S. Pat. No. 6,990,816 and U.S. Pat. No. 6,948,556, which combine the active liquid pumping with the passive capillary liquid management in the wick structure of the evaporator and its liquid/vapor separation. The hybrid cooling loop consists of an evaporator, a condenser, a liquid compensation chamber and a pump as the simplest design. Because of the active amplificatory pumping system, the hybrid loop system could manage different multiple evaporator designs. Despite certain advantages, the necessity of the supplementary loop circulation means can be considered as a drawback because of the active character of critical design components which reduces the reliability and life time of the system.

Another known system developed is the so called advanced LHP which is an LHP with two evaporators: main (functional) and secondary (auxiliary) evaporators, as per document U.S. Pat. No. 6,810,946 B2, for example, incorporating a secondary evaporator to the conventional LHP design. The secondary evaporator is located in a cold-biased environment to ensure that its capillary pump is always primed. Electrical heaters are attached to this evaporator to provide the necessary thermal power for its functioning. With the secondary pump operating, it actively removes the vapor that is accumulated in the compensation chamber by the parasitic heat leaks to the compensation chamber of the main evaporator and to the liquid line. This design considers only a single main evaporator LHP. The main drawback of this approach is the existence of the additional evaporator and its active character. In fact, this solution is needed only for a LHP with not properly designed secondary pump.

Further, an evaporator with attached compensation chamber was proposed to use in a capillary driven loop, known for example per documents U.S. Pat. No. 7,061,446, U.S. Pat. No. 7,268,744 or U.S. Pat. No. 7,841,392. The undivided large capillary wick is used in the evaporator portion and in the compensation chamber. The wick has a greater transverse size in the compensation chamber than in the evaporator portion. There are no means to guarantee vapor tolerance of the evaporators.

Thus, as a summary, it is possible to conclude that the main and the most critical element in a capillary driven loop is the evaporator. The vapor parasitic heat leak intolerance, which can lead to total failure of the system in heat transfer, is the main problem in the development of capillary driven multi-evaporator two phase thermal control systems. Various methods have been proposed and investigated to solve the problem; however, the existing technical solutions still cannot guarantee reliable and stable performance in different actual thermal conditions of spacecraft operation.

The present invention is therefore oriented towards these needs.

SUMMARY OF THE INVENTION

The present invention therefore provides a heat transfer and thermal control system and method, in particular, a two-phase mechanically or capillary driven advanced control heat transfer loop (ACHTL).

An object of the invention is to provide a two-phase mechanically or capillary driven ACHTL having reliable functioning and high performance at a wide range of operation conditions with minimum parasitic heat leak, providing at the same time vapor parasitic heat leak tolerance means for every evaporator and design flexibility by implementation of a remote compensation chamber and advanced temperature control of this chamber.

Another object of the present invention is to provide a two-phase mechanically or capillary driven ACHTL system that can be expanded, that is, that can vary the number of its evaporators and/or its condensers.

Thus, reliability and expandability are main objects. Other objects of the two-phase mechanically or capillary driven ACHTL of the invention are the following:

- scalability: the size (both diameter and length) of the evaporators can vary in a wide range and can be adjusted for any particular application needed;
- controllability: possibility to control the operating temperature of the system by thermal control of the remote compensation chamber;
- capability of heat load sharing when the ACHTL system comprises multiple evaporators: power ranges can be different for each evaporator, such that some evaporators can have the maximum heat load while others have minimum or no power application;
- configuration flexibility: theoretically, an unlimited number of evaporators/condensers can be used; the distance between evaporators and compensation chamber can be up to several meters; evaporators, condensers and remote compensation chamber can be located in a gravity field at various levels with elevation difference up to 3 m taking into account only the capillary potential of evaporators primary pumps;
- functional flexibility: there exists a wide range of heat input powers for the entire system and for every evaporator; resistance to rapid change of power inputs or/and condenser temperatures occurs;
- integration flexibility: small diameter (1-3 mm) tubing connecting evaporators with remote compensation chamber allows easy installation of the system on the satellite level; also, flexible inserts such as tube coils or/and flexible hoses can be used for better integration of the system;
- evaporators standardization: possibility of using compensation chambers attached to the evaporators, having standardized dimensions without the need of effecting any re-qualification of the evaporators for every configuration and size of the whole system; this is especially important for the improvement of the mechanical viability of the two-phase HTL during vibration, as every evaporator of the system has relatively small standardized individual compensation chamber and can be mechanically designed and qualified individually only one time.

These objects are achieved with an ACHTL system comprising the features of claim 1. Preferred embodiments of the system of the invention are claimed in claims 2 to 8.

The above objects are further achieved by a method comprising the features of claim 9. Preferred ways to carry out the method of the invention are claimed in claims 10 to 12.

The system effects heat transfer and thermal control applications with a two-phase fluid as a working media. The system of the invention comprises at least one evaporator, comprising a primary capillary pump, at least one thermal stabilization-compensation chamber and attached to the evaporator, at least one condenser, liquid and vapor lines, a single remote compensation chamber, temperature sensors installed on all compensation chambers of the system, at least one heating element installed on the remote compensation chamber, and a controller. The primary capillary pump of the evaporator serves to absorb heat from the equipment, which has to be cooled, and to provide fluid/heat continuous circulation between the evaporator, which is connected to the heat source, and the condenser, which is connected to the heat sink. A secondary capillary pump is located inside the wick of the primary capillary pump and inside of the thermal stabilization-compensation chamber and serves to distribute and supply with liquid the wick of the primary capillary pump, to provide fluid/heat intermittent circulation in transient regimes of operation of the system, including removing of internal two-phase heat leak through a primary capillary pump by convection and condensation of the bubbles generated on the inner wall of the wick of the primary capillary pump.

The tolerance of the ACHTL system to the parasitic heat leak due to vapor bubbles formation in the central core of wick of the primary capillary pump in transient regimes and the absence of those bubbles in steady state regimes of operation is secured by an advanced method of temperature control. The control scheme consists of controller, temperature sensors and heater on the remote compensation chamber. The controller is managing heating of the remote compensation chamber in such a way that the temperature of the remote compensation chamber is always above the temperature of any of the thermal stabilization-compensation chambers.

Other features and advantages of the present invention will be disclosed in the following detailed description of illustrative embodiments of its object in relation to the attached figures.

DESCRIPTION OF THE DRAWINGS

The features, objects and advantages of the invention will become apparent by reading this description in conjunction with the accompanying drawings, in which.

DETAILED DESCRIPTION OF THE INVENTION

Figure 1A:
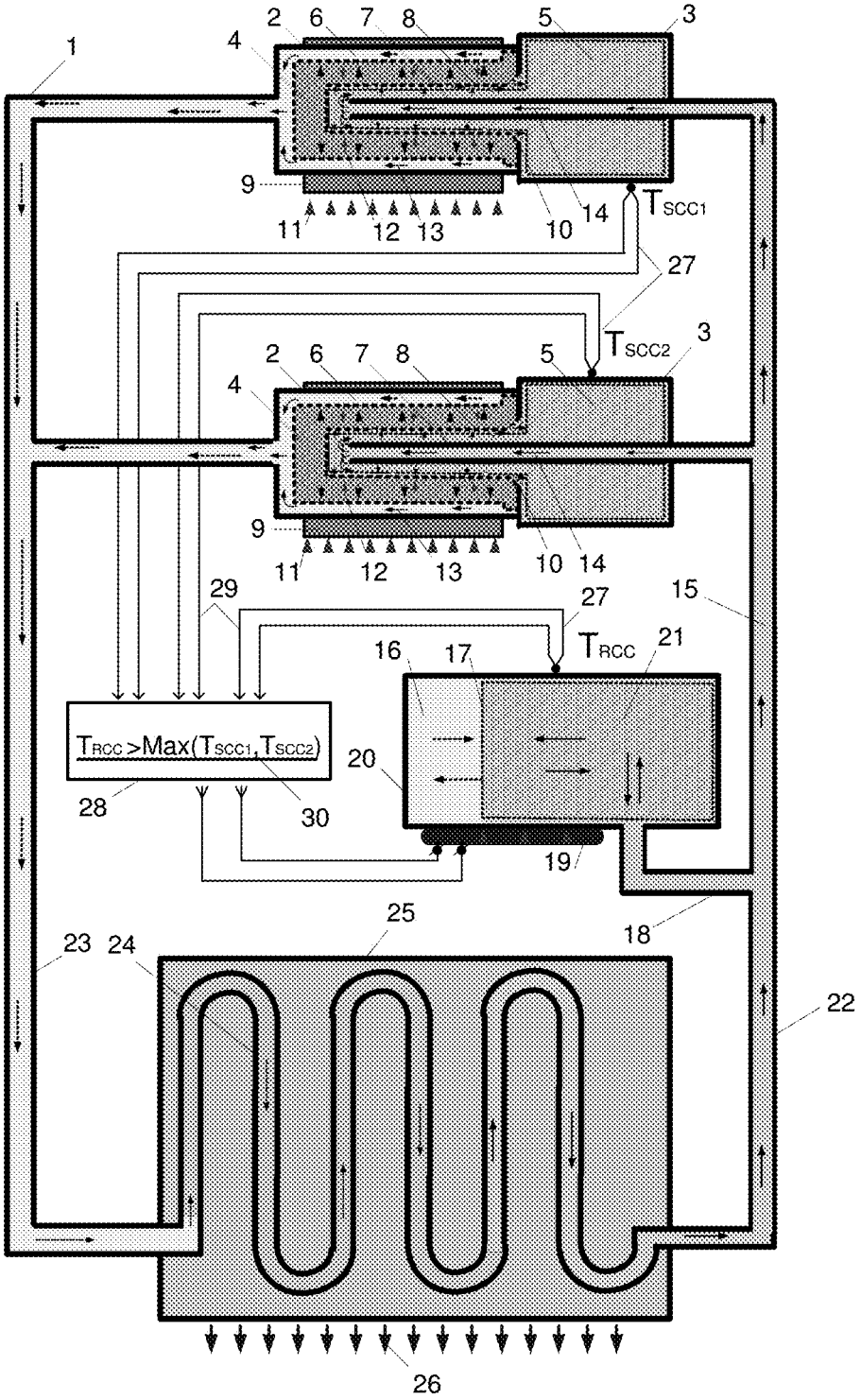
FIGS. 1*a* and 1*b* show schematic views of the ACHTL device of the invention having a remote compensation chamber and two evaporators.
Figure 1B:
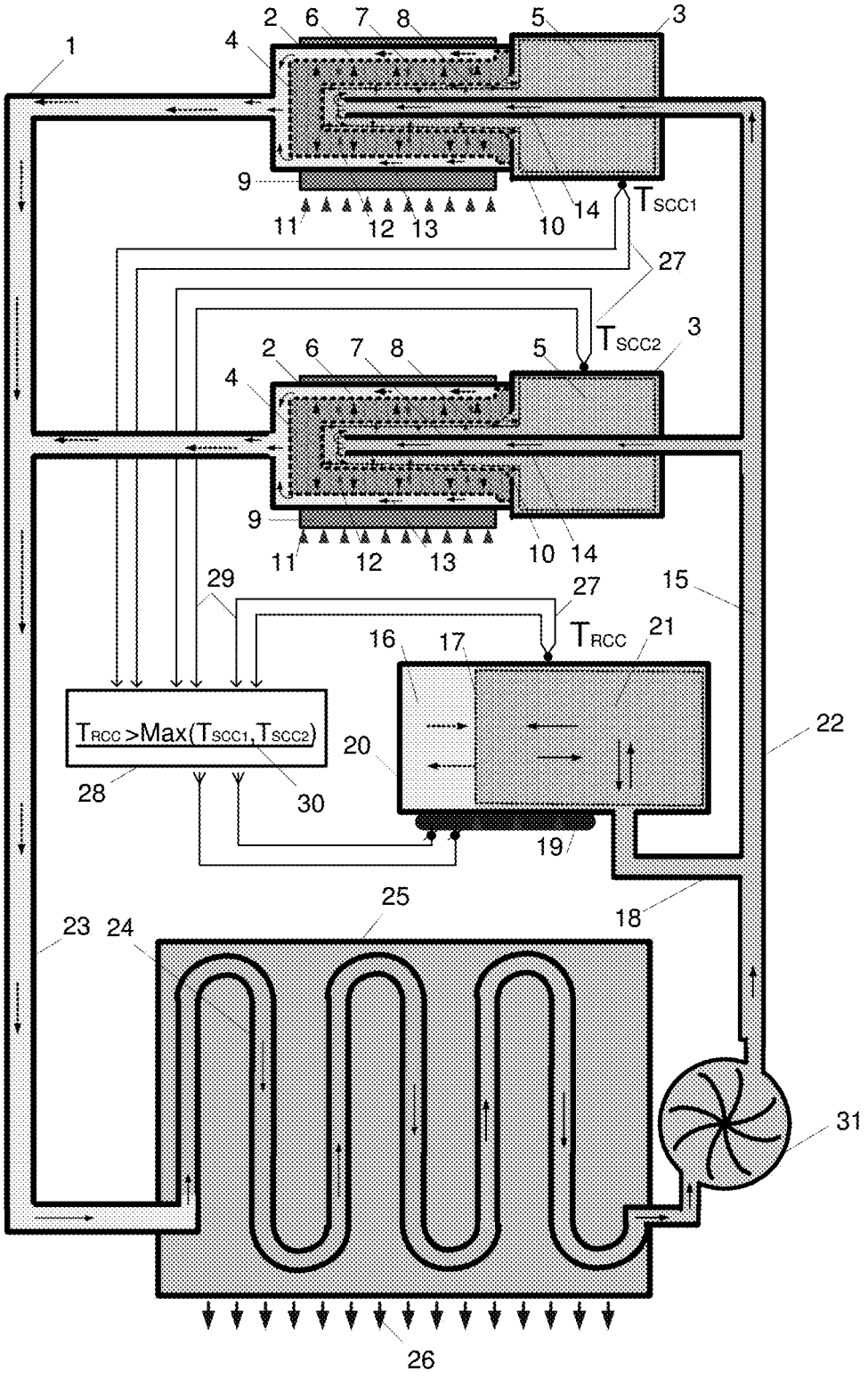
Figure 2:
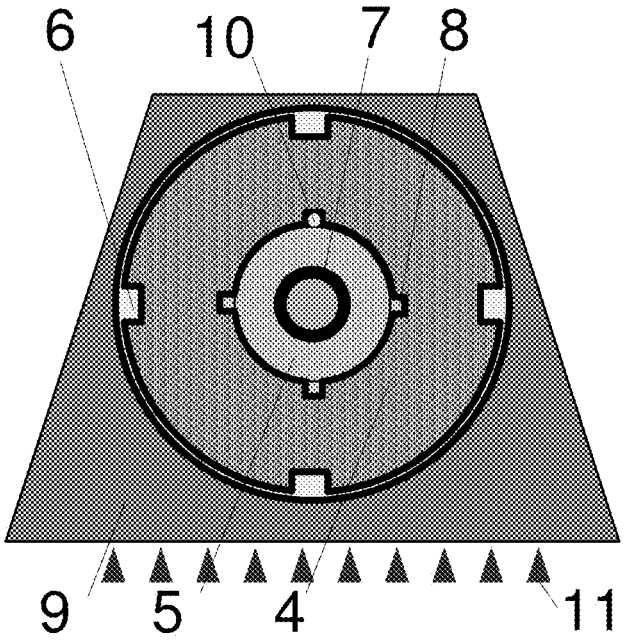
FIG. 2 shows a cross section of the ACHTL evaporator.

The present invention is illustrated by FIGS. 1*a*, 1*b*, 2. When a heat input flow 11 is supplied to an evaporator 2 through an evaporator saddle 9 by a heat releasing equipment or a heat source, the heat evaporates working liquid. The saddle 9 is made from highly thermally conductive material (for instance, aluminium or copper) and it is needed to connect (mechanically and thermally) the evaporator 2 which typically has a cylindrical shape with the heat source (typically, a flat surface, for instance, an electronic chip). The vapor flows from the evaporator 2 to a condenser 27 through a vapor transport line 23, where it is condensed. After that, the working liquid returns to a stabilization-compensation chamber 3 and to the evaporator 2 through a liquid transport line 24, to be again evaporated on the external surface of a primary capillary pump 4 installed in the evaporator 2.

Unlike ordinary LHP systems, the proposed ACHTL device 1 of the invention is controlled by a remote compensation chamber 20, in which two-phases always co-exist. Unlike ordinary CPL systems the stabilization-compensation chamber 3 is provided in the ACHTL for each evaporator 2. The stabilization-compensation chamber 3 is connected and attached to the evaporator 2 and together with an advanced control scheme serves for reliable supplying of the primary capillary pump 4 with a sufficient amount of subcooled liquid in any operational conditions, even in very unfavorable transient ones.

The ACHTL device 1 comprises at least one evaporator 2 (in FIGS. 1*a* and 1*b* two evaporators) comprising the primary capillary pump 4, at least one thermal stabilization-compensation chamber 3, at least one condenser 24, liquid and vapor lines 22 and 23, a single remote compensation chamber 20 comprising a capillary structure 21, temperature sensors 27 installed at all compensation chambers 3 and 22 of the system, at least one heating element 19 installed at the remote compensation chamber, and an automatic controller 28. The remote compensation chamber 20 is hydraulically connected with the thermal stabilization-compensation chamber 3 and the condenser 24 through a liquid feeding line 18 and liquid line 22. The primary capillary pump 4 of the evaporator 2 serves to absorb heat from the heat source 11 (equipment, which has to be thermally controlled), and to provide fluid/heat continuous circulation between the evaporator 2 connected with heat source 11 and the condenser 24, which is attached to a heat sink 25. The main part of the absorbed heat is used for evaporation of working fluid. Released vapor flows through vapor removing channels 6 and then through vapor line 23 towards the condenser 24 where heat stored in the vapor phase is released to the heat sink 25 by condensation. The vapor flow 13 is caused by temperature and corresponding pressure gradients between evaporator 2 and condenser 24. A small part of total heat input 11 can reach the central core of the wick of the primary capillary pump 4. This is a parasitic heat leak 12 because this heat degrades HTL conductance performance and has to be minimized. A secondary capillary pump 5 is located inside the wick of the primary capillary pump 4 and inside of the thermal stabilization-compensation chamber 3 and serves to distribute and supply the wick of the primary capillary pump 4 with liquid to provide fluid/heat intermittent circulation in transient regimes of operation of the ACHTL, including removing of internal parasitic heat leak 12 through vapor bubbles removing channels 8 of the primary capillary pump 4 by convection and condensation of the bubbles 10 generated on the inner wall of the pump 4.

The tolerance of the ACHTL system 1 to the vapor bubble 10 appearance in the central core of wick of the primary capillary pump 4 in transient regimes and absence of those bubbles in steady state regimes of operation of the ACHTL is secured by the presence of stabilization compensation chamber(s) 3 together with an advanced method of temperature control. Parasitic heat leak is minimal if boiling (and the bubble flow 10, corresponding to this process) does not take place inside of primary capillary pump 4. In this situation ACHTL has maximum performance. It means that only liquid phase 15 is presented in the central core of primary capillary pump 4, in secondary capillary pump 5 and in the thermal stabilization-compensation chamber 3 in steady state mode of ACHTL device 1 operation. However in transient regimes when the heat input 11 power or/and temperature of the heat sink 25 are changing rapidly it is often impossible to avoid the generation of bubbles 10. Then, the bubbles 10 move to the stabilization compensation chamber 3 where they are condensing. This is possible only if this chamber has sufficiently low temperature during all transient modes of ACHTL operation. The advanced control scheme and method guarantee proper operation of the system in all regimes. The control scheme consists of a controller 28, temperature sensors 27 and a heater 19 at the remote compensation chamber 20. The controller 28 controls the heating of the remote compensation chamber 20 in such a way that the temperature of the remote compensation chamber $T_{RCC}$ is always above the temperature of any of thermal stabilization-compensation chambers $T_{SCC}$ according to the control algorithm 30.

The ACHTL device 1 of the invention can be of the type of a single evaporator-condenser or of multiple evaporators (and/or condensers) embodiments. To enhance ACHTL performance a pump 31 can be installed in the liquid line 22, as shown in FIG. 1*b*. The ACHTL device 1 of the invention comprises the following components:

- at least one evaporator 2;
- one remote compensation chamber 20 in a two-phase condition for temperature control functions and for managing changes of liquid phase volume. Presence of one remote compensation chamber 20 provides expandability in embodiments having multiple evaporators 2; in that case there is no need for the stabilization-compensation chambers 3 having a large volume, as they can have a minimal volume, enough to manage and ensure tolerance of vapor bubbles 10 in transient regimes;
- at least one condenser 24;
- a vapor line 23 and a liquid line 22;
- an advanced control scheme comprising temperature sensors 27 installed at every compensation chamber 3, 20, a controller 28 and a heating element 19 for the remote compensation chamber 20.

Figure 3A:
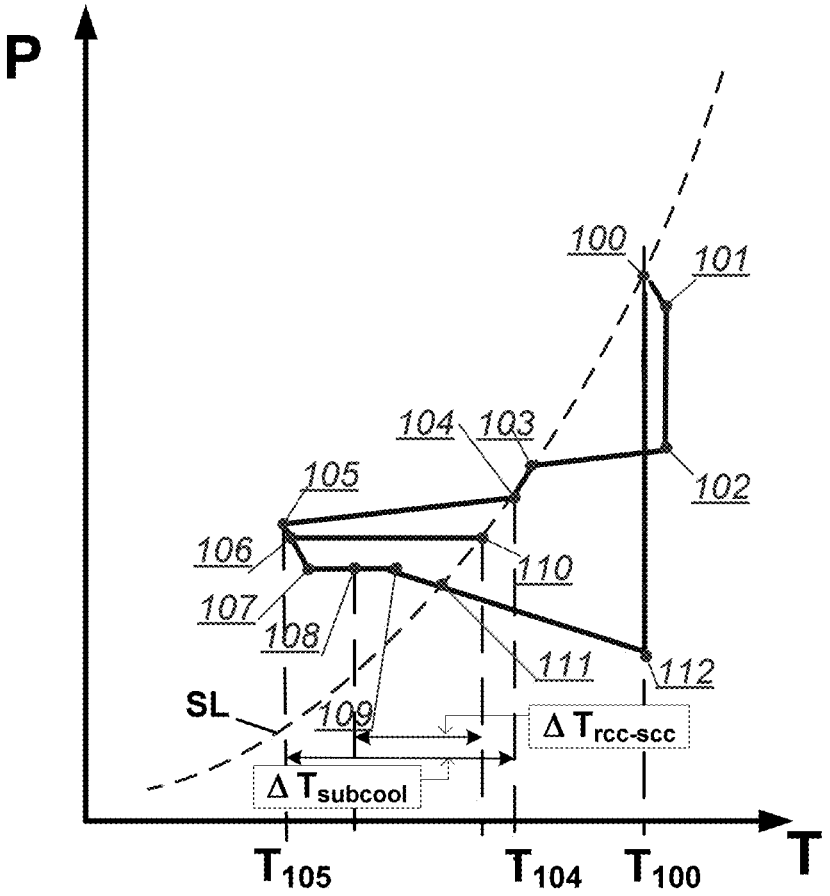
FIGS. 3*a* and 4*a* show a pressure-temperature diagram of an ACHTL thermodynamic cycle which illustrates the main principle of ACHTL operation.
Figure 3B:
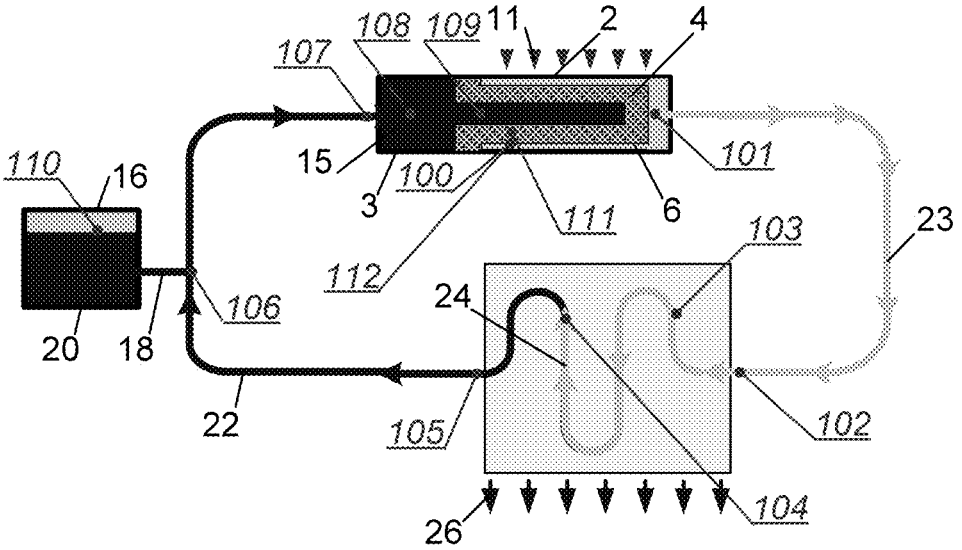
FIGS. 3*b* and 4*b* show ACHTL schematics which correspond to pressure-temperature diagrams shown on FIGS. 3*a* and 4*a*.
Figure 4A:
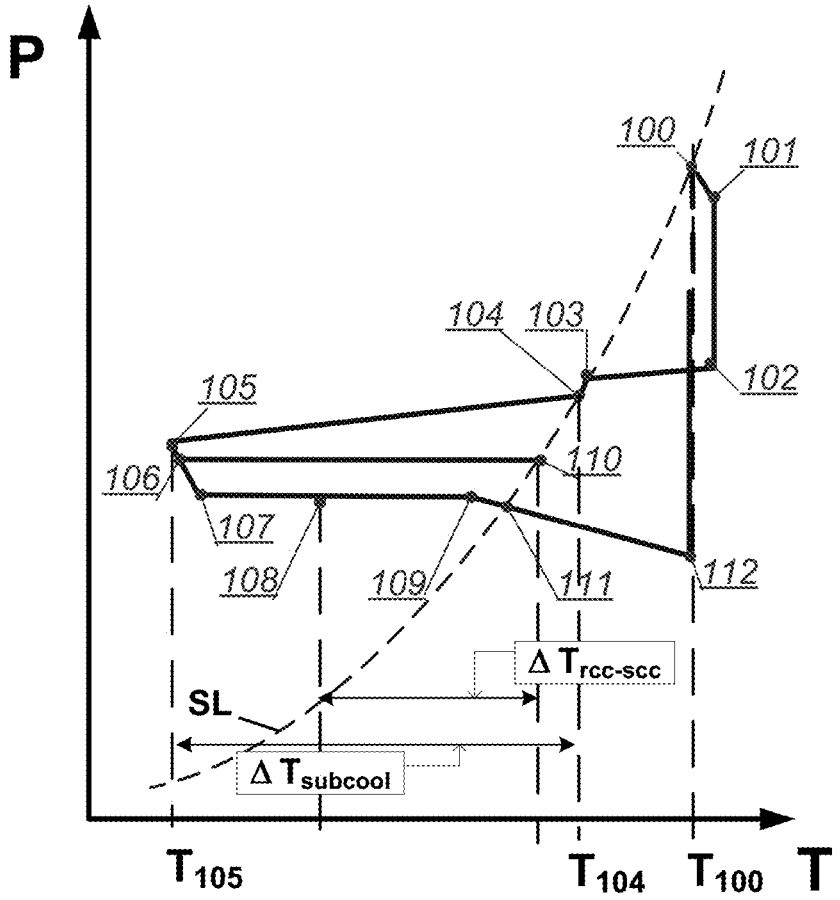
Figure 4B:
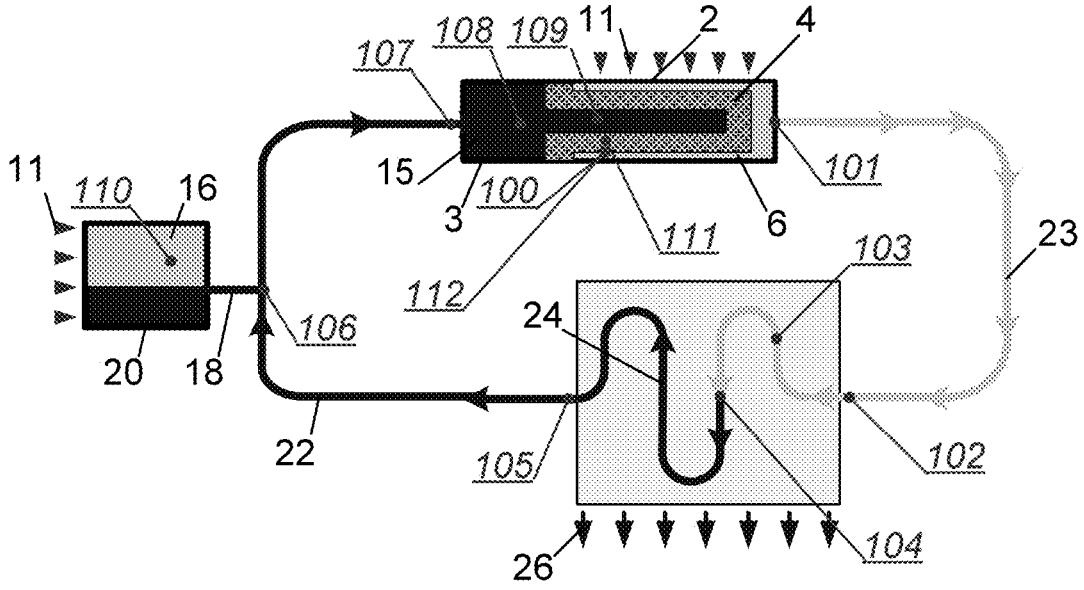

The numerals shown in FIGS. 1*a*-1*b*, 2 and 3*a*-3*b* represent the following:

1—Advanced Control Heat Transfer Loop device;
2—Evaporator;
3—Thermal Stabilization compensation chamber;
4—Primary capillary pump;
5—Secondary capillary pump;
6—Vapor removing channels outside the wick of the primary capillary pump;
7—Bayonet tube;
8—Vapor bubbles removing channels inside of the wick of the primary capillary pump;
9—Evaporator saddle;
10—Vapor bubbles in central core of wick of the primary capillary pump;
11—Heat input flow;
12—Heat leak flow into central core of wick of the primary capillary pump;
13—Vapor flow direction;

14—Liquid flow direction;
15—Liquid;
16—Vapor;
17—Vapor-liquid front in remote compensation chamber;
18—Liquid feeding line to/from remote compensation chamber;
19—Heater at remote compensation chamber;
20—Remote compensation chamber;
21—Capillary structure inside of remote compensation chamber;
22—Liquid line;
23—Vapor line;
24—Condenser saddle or plate;
25—Heat sink;
26—Heat output flow;
27—Temperature sensor;
28—Analog or digital controller;
29—Electrical conductor;
30—Control algorithm
31—Pump The explanation of the physical model of the advanced control is illustrated on FIGS. 3*a*, 3*b* and 4*a*, 4*b*. Since the device of the invention is an evaporating-condensing heat transfer apparatus, it operates around the vapor-liquid saturation line SL. Two closed thermodynamic cycles of ACHTL operation are shown on the pressure (P)—temperature (T) diagrams in FIGS. 3*a* and 4*a*. The points from 100 to 112 on the diagrams correspond to certain thermodynamic states of working fluid in different locations of ACHTL as shown in FIGS. 3*b* and 4*b*. At position (100) liquid evaporates from the external surface of the wick of the primary capillary pump 4 and flows to the outlet of the evaporator 2, path (100-101). In this step, some vapor overheating can take place. After that, vapor flows into the vapor line 23 (path 101-102), the temperature of vapor in the vapor line 3 being maintained close to constant (there is no heat exchange with the ambient) though the vapor pressure in the line 23 is reduced. In the condenser 24 (path 102-103-104-105), vapor is cooled up to saturation state (102-103), then condensed (103-104) and the liquid condensate is further subcooled (104-105). Pressure is further reduced on the way of liquid to evaporator 2 (105-106-107) due to friction losses in the conduit 22. Flowing down in the line (105-106-107) the liquid can keep the constant temperature, and can be cooled or be heated (as it is shown on the diagram) depending on the thermal environment conditions of the liquid line 22. In the remote compensation chamber 20, the vapor 16 and liquid 15 phases are always presented in equilibrium and the temperature of this chamber is the defining point for entire HTL since whole cycle depends on this point (110). The flow in the line 18 can be presented only in transient regimes, therefore there is no pressure drop between the points (106) and (110). The subcooled liquid from the condenser 24 is first heated in the stabilization compensation chamber 3 (107-108) and afterwards inside of the central core of the wick of the primary capillary pump 4 (108-109) absorbing the parasitic heat leak 12. The liquid passes the saturation line inside the wick (111) but it can not boil due to constrained conditions inside of the wick micro capillaries (surface tension forces are preventing growing of bubbles). From point (111) to (112) liquid is superheated and pressure is further reduced during the filtration through the porous structure (109-111-112). The cycle is closed at vapor-liquid interface-meniscus where evaporation takes place (112-100). Point (112) corresponds to the liquid phase just under the meniscus, point (100) corresponding to the vapor phase just above the meniscus.

As it is clear from the diagram in FIG. 3*a*, an insufficient subcooling will lead to the reduction of the temperature difference between points (107) and (112) and finally to a situation when the points (109) and (111) become equal. In this case the liquid will start to boil inside of the central core of wick of the primary capillary pump 4, which will lead to a sudden increase of parasitic heat leak, to degradation of HTL thermal conductance and finally to the dryout of the wick and to interruption of the fluid circulation (failure of HTL operation). Thus, the liquid subcooling (104-105) is the fundamental parameter for proper and stable operation of any HTL.

Especially important for transient regimes are rapid large changes of heat sink, heat source or ambient conditions such as heat source input power, condenser and ambient temperatures or heat exchange conditions that can provoke dryout of the evaporator(s) due to insufficient subcooling.

To guarantee proper operation of the HTL in all regimes it is proposed to control the temperature of remote compensation chamber 20 in such a way that for all scenarios of ACHTL operation there is enough liquid subcooling to compensate parasitic heat leak before point (109) will converge with point (111): dryout. As it is shown on FIG. 4*a* the increase of temperature difference between remote and stabilization compensation chambers $T_{110}-T_{108}=\Delta T_{RCC-SCC}$ will cause the increase of the overall subcooling temperature drop $T_{104}-T_{106}=T_{Subcool}$. The necessary differences of temperatures can be obtained by heating of remote compensation chamber (FIG. 4*a*, heat input 11 to remote compensation chamber 20). Due to this heating the liquid from the remote compensation chamber 20 is pushed into condenser 24 (vapor is expanding). It leads to a larger length of the liquid path in the condenser and finally to an increase of subcooling rate of the liquid.

The following transient regimes of ACHTL can be identified:

1. Startup. This event is most stressful and less predictable for the system since it depends not only on initial temperatures of ACHTL elements and applied power to evaporator but also on the original allocation of vapor and liquid phases inside ACHTL.
2. Shut down. On case of multiple evaporators the effect of ACHTL power switching off for one or several evaporators, keeping rest of the evaporators operating can lead to sudden vapor and liquid flows redirections and to strong oscillations end even to dryout of the system.
3. Evaporator input power increase
4. Evaporator input power decrease
5. Condenser temperature increase
6. Condenser temperature decrease
7. Combinations of conditions 3-5, 3-6, 4-5, 4-6 for one-evaporator one-condenser ACHTL
8. Multiple combinations of conditions 1-2-3-4-5-6 for multi-evaporator multi-condenser ACHTL
9. Change of transport lines environmental thermal conditions which also can be combined with all above mentioned cases 1-8.

The more complex the system is, the more combinations are possible, the more it is difficult to predict and test the system behavior in transient mode of operation. The solution is to actively control the transient behavior by controlling the temperature of the remote compensation chamber according to following rules:

$$T_{RCC}+\Delta T_{control}=T_{SCC}$$

For one evaporator design ACHTL $$T_{RCC}+\Delta T_{control}=\mathrm{Max}(T_{SCC1}T_{SCC2}, \ldots T_{SCCn})$$

for multiple n-evaporators design ACHTL

This control will suppress all possible unwanted reverse flows and oscillations which can cause system failure. The selection of the parameter $\Delta T_{control}$ is performed by modeling, considering most stressful transient scenarios of operation for ACHTL, such as maximum change and maximum ramp of input powers and condenser temperatures, orientation in gravity field, transport lines thermal environmental conditions, etc. During the test campaign the parameter $\Delta T_{control}$ can be adjusted. Too large values of $\Delta T_{control}$ can lead to unwanted degradation of ACHTL performance (lowered thermal conductance) in many nominal regimes of operation and finally to oversizing of the system since the subcooling is a function of condenser dimensions: higher subcooling needs larger condenser area. However, too small values of $\Delta T_{control}$ can provoke ACHTL failure in transient modes. Typically, $\Delta T_{control}$ lies in the range of 1÷10° C. To optimize the performance of the system the variable $\Delta T_{control}$ as a function of ACHTL operational mode can be used. For instance: prior to startup event it is desirable to have large temperature differences between remote and stabilization compensation chambers (for instance, 5° C.) but after startup when all temperatures are stabilized it is possible to reduce $\Delta T_{control}$ (for instance, 2° C.) to increase the performance of the ACHTL and reduce power consumption of the active control.

The ACHTL device 1 can contain several evaporators 2 and several parallel condensers 24 even if in FIGS. 1*a* and 1*b* only two evaporators and one condenser are shown.

The opportunity is provided that the evaporators 2 can collect the power from different heat sources, which could be located far one from the others thanks to the flexibility/adaptability provided by the ACHTL device 1 concept.

The design of the volume of the stabilization-compensation chamber has to provide the possibility to cool and condense vapor bubbles generated by parasitic heat leak 12 (the chamber is functioning as a cold accumulator, providing effective compensation of the heat leak); to supply the liquid to primary capillary pump 4 (the chamber is functioning as a liquid accumulator, providing compensation of reduced liquid flow from condenser before the flow is fully developed and stabilized) in worst transient modes of ACHTL operation.

A remote compensation chamber 20 (common for all evaporators 2 of multiple evaporator option) included in the proposed design serves to accumulate liquid and to compensate the liquid volume changes during the ACHTL device 1 operation. This large reservoir helps to avoid the obligation of designing a large volume compensation chamber for the individual evaporators in the multiple evaporator option. Therefore, this configuration allows to have a scalable design which can be fitted easier to the required number of evaporators and the specific requirements of each application, because evaporators will have the same design independently of the design and volume of the lines 18, 22, 23, condensers 24, total number of evaporators, etc. Only the volume of the remote compensation chamber 20 has to be adjusted for every specific ACHTL design.

The advanced temperature control of the remote compensation chamber 20 can be realized in different ways, depending on each application requirements with the help of:

- a heater placed on the external surface of the remote compensation chamber (film type heater)
- a heater integrated into remote compensation chamber (cartridge type heater)
- a thermal electrical cooler placed on the external surface of the remote compensation chamber with the option to heat up or cool down by a change of voltage polarity Although the present invention has been fully described in connection with preferred embodiments, it is evident that modifications may be introduced within the scope thereof, not considering this as limited by these embodiments, but by the contents of the following claims.

The invention claimed is:

1. Advanced control heat transfer loop apparatus for heat transfer and thermal control applications, using a two-phase fluid as a working media and comprising:

at least one evaporator to be connected with a heat source and comprising a primary capillary pump, a thermal stabilization-compensation chamber being attached to said at least one evaporator, at least one condenser to be connected with a heat sink, liquid lines and vapor lines connecting said at least one evaporator and said at least one condenser, a remote compensation chamber, temperature sensors for detecting the temperature of said remote compensation chamber and at said thermal stabilization compensation chamber attached to said at least one evaporator, at least one heating element for heating said remote compensation chamber, and a controller, wherein said primary capillary pump is connected to said thermal stabilization compensation chamber by means of a secondary capillary pump providing a gravity field independent operation of said evaporator, wherein said controller is configured to monitor the temperatures detected by said sensors and to control said heating element in such a way that the value of the difference $\Delta T_{Control}$ between the temperature of said remote compensation chamber and the temperature of said thermal stabilization compensation chamber attached to said at least one evaporator is positive.

2. Advanced control heat transfer loop for heat transfer and thermal control applications according to claim 1, wherein the positive value of the difference $\Delta T_{Control}$ between the temperature of said remote compensation chamber and the temperature of said thermal stabilization compensation chamber attached to said at least one evaporator is a fixed value.

3. Advanced control heat transfer loop for heat transfer and thermal control applications according to claim 1, wherein the positive value of the difference $\Delta T_{Control}$ between the temperature of said remote compensation chamber and the temperature of said thermal stabilization-compensation chamber attached to said at least one evaporator is a value variable according to a function of modes of operation of the advanced control heat transfer loop.

4. Advanced control heat transfer loop for heat transfer and thermal control applications according to claim 1, wherein the controller is configured to provide a stabilization of the temperature of the heat source at a fixed value above the difference $\Delta T_{Control}$ between the temperature of said remote compensation chamber and the temperature of said thermal stabilization-compensation chamber attached to said at least one evaporator.

5. Advanced control heat transfer loop for heat transfer and thermal control applications, according to claim 1, wherein said primary capillary pump comprises outer vapor channels to collect and remove heat from a cooled equipment and inner vapor channels to collect and remove vapor bubbles produced by parasitic heat leak penetrating through said primary capillary pump.

6. Advanced control heat transfer loop for heat transfer and thermal control applications according to claim 1, wherein said remote compensation chamber comprises an internal capillary structure to assure continuous presence of liquid phase in said inlet of the liquid feeding line to said remote compensation chamber.

7. Advanced control heat transfer loop for heat transfer and thermal control applications according to claim 1, further comprising a liquid pump in the liquid line.

8. A method for operating an advanced control heat transfer loop apparatus for heat transfer and thermal control applications, the apparatus using a two-phase fluid as a working media and comprising:

at least one evaporator to be connected with a heat source and comprising a primary capillary pump, a thermal stabilization-compensation chamber being attached to said at least one evaporator, at least one condenser to be connected with a heat sink, liquid lines and vapor lines connecting said at least one evaporator and said at least one condenser, a remote compensation chamber, at least one heating element for heating said remote compensation chamber, and a controller, wherein said primary capillary pump is connected to said thermal stabilization compensation chamber by means of a secondary capillary pump providing a gravity field independent operation of said evaporator, wherein the temperatures of said remote compensation chamber and at said thermal stabilization compensation chamber attached to the at least one evaporator are detected and monitored and the heating element is controlled in such a way that the value of the difference $\Delta T_{Control}$ between the temperature of said remote compensation chamber and the temperature of said thermal stabilization-compensation chamber attached to said at least one evaporator is positive.

9. The method according to claim 8, wherein the positive value of the difference $\Delta T_{Control}$ between the temperature of said remote compensation chamber and the temperature of said thermal stabilization compensation chamber attached to said at least one evaporator is a fixed value.

10. The method according to claim 8, wherein the positive value of the difference $\Delta T_{Control}$ between the temperature of said remote compensation chamber and the temperature of said thermal stabilization-compensation chamber attached to said at least one evaporator is a value variable according to a function of modes of operation of said advanced control heat transfer loop.

11. The method according to claim 8, wherein a stabilization of the temperature of the heat source at a fixed value above the difference $\Delta T_{Control}$ between the temperature of said remote compensation chamber and the temperature of said thermal stabilization-compensation chamber attached to said at least one evaporator is provided.

* * * * *